US007097275B2

(12) United States Patent
Murcia et al.

(10) Patent No.: US 7,097,275 B2
(45) **Date of Patent: *Aug. 29, 2006**

(54) SINGLE ACTUATION AXIS PRINTHEAD CLEANER ARCHITECTURE FOR STAGGERED PRINTHEADS

(75) Inventors: Antoni S. Murcia, San Diego, CA (US); Ted T. Lee, San Diego, CA (US)

(73) Assignee: Hewlett-Packard Development Company, L.P., Hoston, TX (US)

( * ) Notice: Subject to any disclaimer, the term of this patent is extended or adjusted under 35 U.S.C. 154(b) by 474 days.

This patent is subject to a terminal disclaimer.

(21) Appl. No.: 10/682,502

(22) Filed: Oct. 9, 2003

(65) Prior Publication Data

US 2004/0070644 A1 Apr. 15, 2004

Related U.S. Application Data

(63) Continuation of application No. 09/978,483, filed on Oct. 16, 2001, now Pat. No. 6,644,775.

(51) Int. Cl.
*B41J 2/165* (2006.01)

(52) U.S. Cl. ..... 347/32; 347/29; 347/30; 347/33; 347/35

(58) Field of Classification Search ..... 347/22–24, 347/28, 29, 30, 32, 33, 35
See application file for complete search history.

(56) References Cited

U.S. PATENT DOCUMENTS 5,801,725 A 9/1998 Neese et al.
6,203,135 B1 3/2001 Murcia et al.
6,644,775 B1 * 11/2003 Murcia et al. ..... 347/24

OTHER PUBLICATIONS

Patent Abstracts of Japan v 1995, n 10; Nov. 30, 1995 & JP 07 171975 A (Mita Ind Co. Ltd) Jul. 11, 1995.

* cited by examiner

*Primary Examiner*—Shih-Wen Hsieh

(57) ABSTRACT

System and methods for servicing staggered printheads in an inkjet-imaging device are described. In one aspect, the color inkjet-imaging device collectively moves one or more of the staggered printheads along a single actuation axis from a respective spittoon in a particular service station to a print zone without colliding with any portion of an adjacent cleaning unit.

30 Claims, 16 Drawing Sheets

SINGLE ACTUATION AXIS PRINTHEAD CLEANER ARCHITECTURE FOR STAGGERED PRINTHEADS

RELATED APPLICATIONS

This application is a continuation under 37 CFR 1.53(b) of U.S. patent application Ser. No. 09/978,483, titled "Single Actuation Axis Printhead Cleaner Architecture for Staggered Printheads", filed on Oct. 16, 2001, now U.S. Pat. No. 6,644,775 and hereby incorporated by reference.

TECHNICAL FIELD

The following systems and methods pertain to color inkjet printers.

BACKGROUND

Good print quality is of considerable importance to the inkjet printer industry and consumers alike. Since images are formed of thousands of individual dots, the quality of the image is ultimately dependent upon the quality of each dot and the arrangement of the dots with respect to one another on the print medium. Even in view of existing techniques that address print quality, there is a continuing need to improve imaging architectures and procedures to provide better print quality in manners that are more efficient.

SUMMARY

Systems and methods for servicing staggered printheads in an inkjet-imaging device are described. In one aspect, the color inkjet-imaging device collectively moves one or more of the staggered printheads along a single actuation axis from a respective spittoon in a particular service station to a print zone without colliding with any portion of an adjacent cleaning unit.

BRIEF DESCRIPTION OF THE DRAWINGS

The following detailed description references the accompanying figures. In the figures, the left-most digit of a component reference number identifies the particular figure in which the component first appears.

DETAILED DESCRIPTION

Overview

To maintain image quality in view of ink nozzle plugging, inkjet printers typically include a service station with one or more printhead cleaners to protect and clean printhead ink nozzles. To address undesired bi-directional hue shift imaging defects when printing secondary colors, better print quality can be achieved with a staggered printhead configuration, wherein ink drop colors can be imaged in the same order, regardless of whether imaging is bi-directional. Unfortunately, such staggered printhead architectures cannot move staggered printheads from respective cleaning units to the print zone in a single straight path (single actuation axis) without colliding with adjacent cleaning units. Instead and to avoid such collisions, any existing such systems may have to perform multiple independent movements of which at least one is orthogonal to the direction of the print zone to avoid adjacent service stations. This would likely result in the need for excessively large architectural footprints to move the printheads orthogonal to/from the print zone to avoid collisions with any adjacent printhead service stations.

To address these problems, the following described systems and methods provide a single actuation printhead cleaner framework to service staggered printheads. This is a significant benefit as compared to traditional techniques, which are not typically capable of servicing staggered printheads and moving them to the print zone in a single actuation axis. The printhead cleaning unit has a number of re-positioned components as compared to traditional cleaning units. These repositions, in combination with coordinated service station and imaging device carriage movement, provide unhindered movement of the printheads into and out of the servicing station along a single actuation axis—i.e., a single straight line from the service stations to the print zone.

Figure 1:
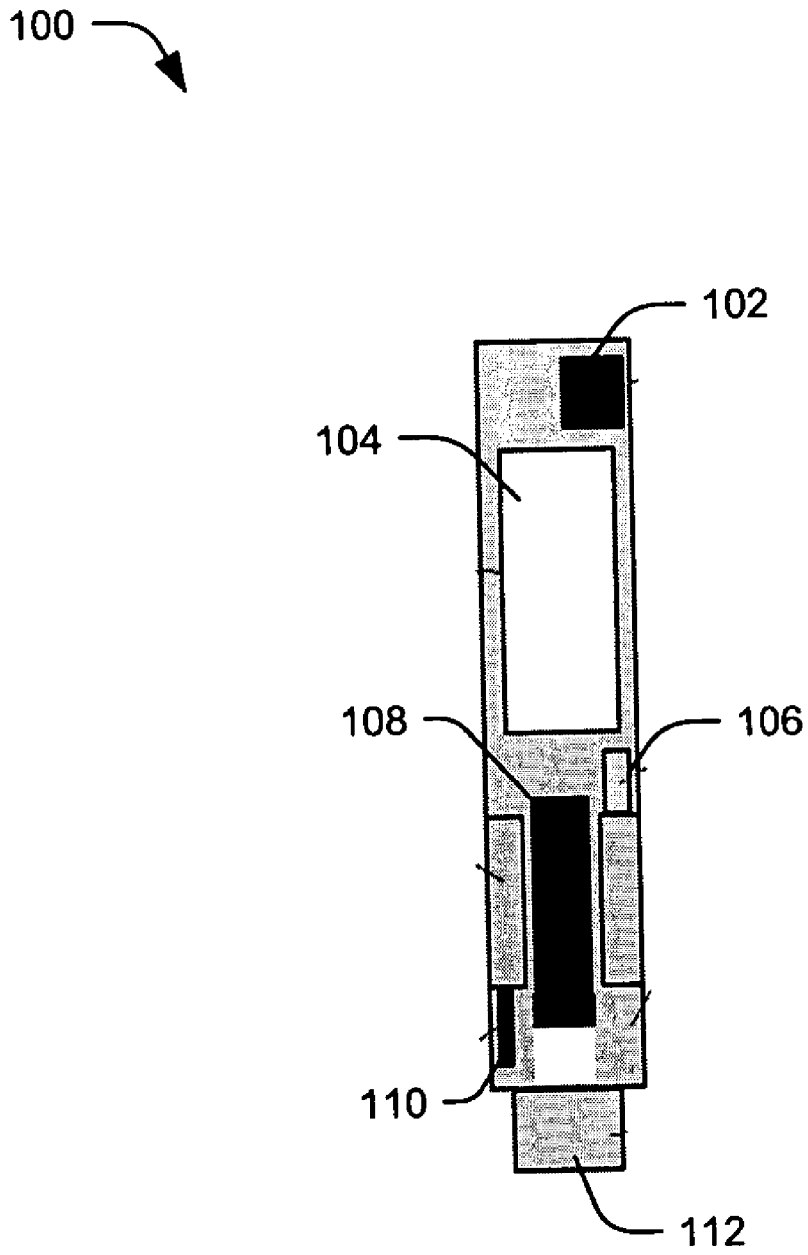
Fig. 1 (Prior Art)
FIG. 1 is a top perspective view of an existing printhead cleaner.

To fully differentiate the single actuation axis architecture of the proposed systems and methods, we first describe problematic aspects of conventional printhead cleaning unit architectures. FIG. 1 shows a top-view perspective of a conventional printhead cleaner 100. The cleaner includes a wiper 102, a spittoon reservoir 104, an ink solvent nib 106, capping system 108, a wiper snout 110, and a handle 112. The wiper 102 wipes the printhead surface to remove ink residue, as well as any paper dust or other debris that has collected on the face of the printhead. During operation, potential clogs in the printhead are periodically cleared by firing a number of drops of ink through each of the nozzles in a process known as "spitting," with the waste ink being collected in the spittoon reservoir 104 of the printhead cleaner.

The ink solvent nib 106 is used to deliver an inkjet ink solvent to a printhead that is being serviced. The solvent is a hygroscopic material that absorbs water out of the air (water is a good solvent for ink). Suitable hygroscopic solvent materials include, for example, polyethylene glycol ("PEG"). Such hygroscopic materials are liquid or gelatinous compounds that will not readily dry out during extended periods because they have an almost zero vapor pressure. For storage, or during non-printing periods, the cleaner assembly 100 includes a capping system 108 to seal printhead nozzles from contaminants and drying. A snout wiper 110 is for cleaning a rearward facing vertical wall portion of a printhead, which leads up to an electrical interconnect portion of the printhead. Each cleaning unit includes an installation and removal handle 112, which may be gripped by an operator when installing the cleaner unit in their respective chambers or stalls.

Figure 2:
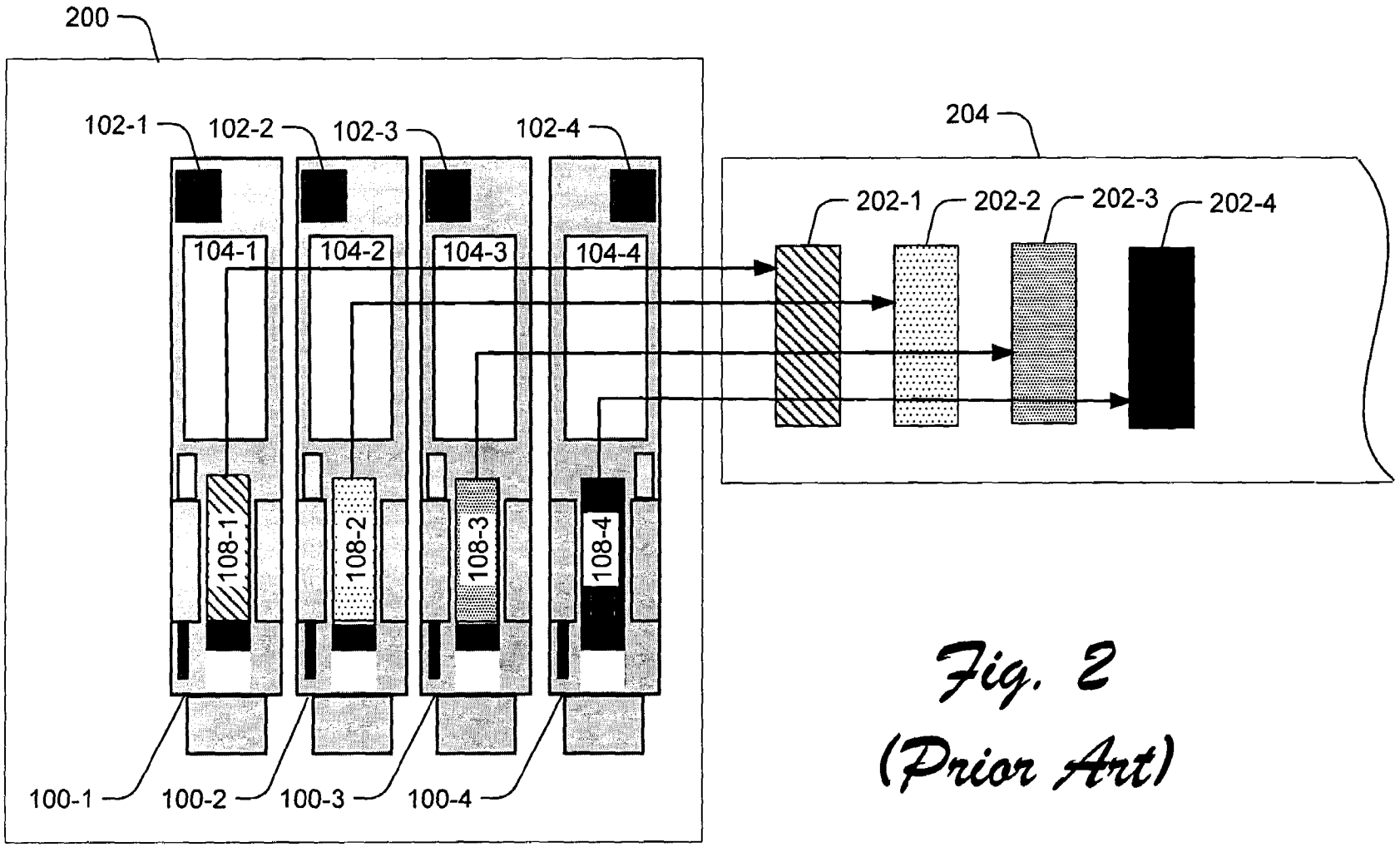
Fig. 2 (Prior Art)
FIG. 2 shows a top perspective of a conventional service station housing four (4) printhead-cleaning units for servicing four respective printheads in a linear configuration.
Figure 6:
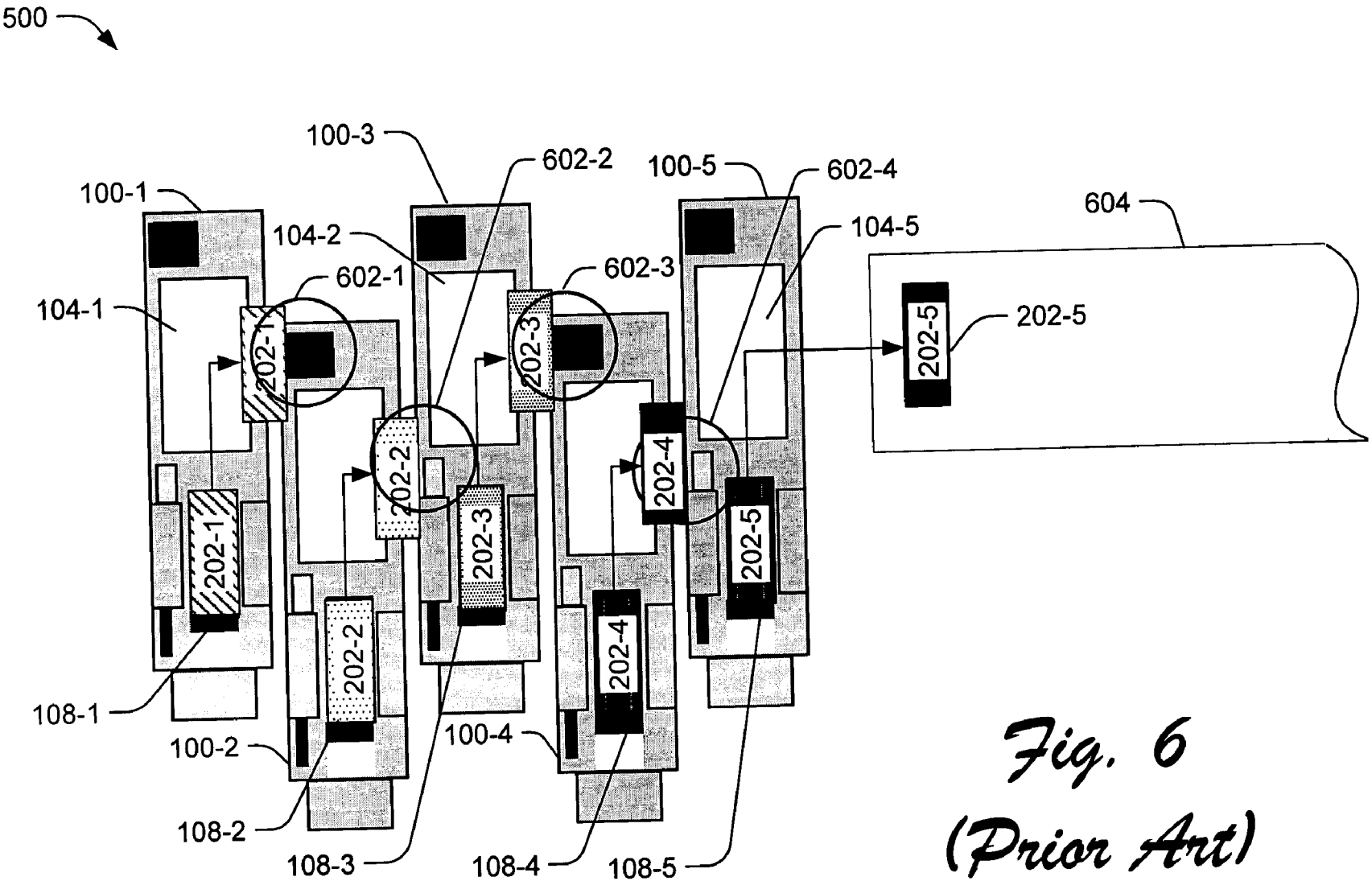
Fig. 6 (Prior Art)
FIG. 6 shows that when an attempt is made to move staggered printheads from conventional capping stations to respective spittoon reservoirs, and into to a print zone, four of the five printheads collide with portions of a conventional adjacent cleaning unit.
Figure 7:
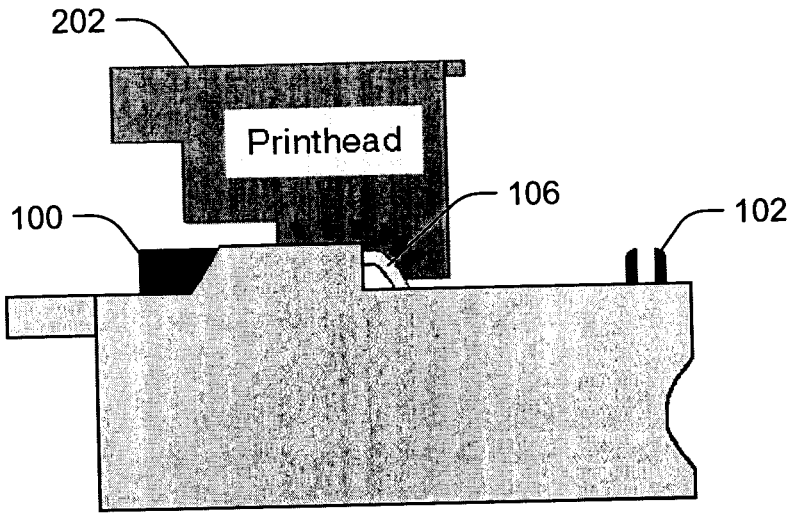
Fig. 7 (Prior Art)
FIG. 7 shows a collision of a printhead with a nib attached to a conventional cleaning unit positioned adjacent to the printing unit used to service the printhead, such a collision being a problem with conventional printhead-service station configurations.

FIG. 2 shows a top perspective of a conventional service station 200 housing four (4) printhead-cleaning units 100 of FIG. 1 for servicing four respective printheads 202. (For purposes of discussion, recall that in the figures, the left-most digit of a component reference number identifies the particular figure in which the component first appears). Such a service station is typically located on top of a moving palette (not shown) that actuates in a linear motion. The printheads are attached to a carriage that moves horizontally with respect to the print media (not shown) that is being imaged. The cleaning units are latched to the service station in a linear or in line configuration such that they can service the printheads, which are also aligned in a linear configuration. The arrows illustrate motion of the printheads 202 with respect to the cleaning units 100, as they are uncapped from capping region 108, moved to the spittoon 104 for spitting, and moved to the print zone 204 for imaging. Although the motion is shown from the perspective of moving printheads, typically both printheads and printhead deaning units in this configuration move in the imaging device. Relative motion of printheads 202 with respect to conventional cleaning units 100, as they are uncapped from the capping regions 108, moved to spittoons 104 for spitting, and moved to the print zone 204 for Imaging, are shown in FIGS. 6 and 7, which are discussed below. (FIGS. 6 and 7 emphasized that the printheads are hindered with respect to access to the print zone).

Figure 3:
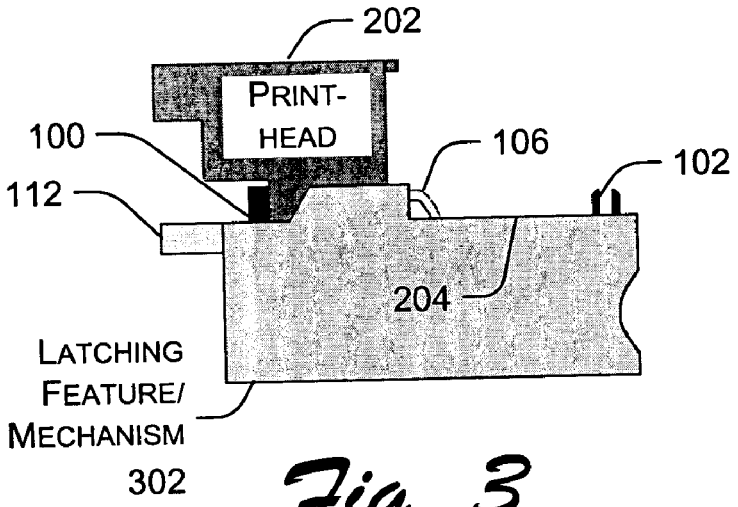
Fig. 3 (Prior Art)
FIG. 3 is a side perspective of a conventional latching mechanism in an inkjet-imaging device for housing a conventional printhead cleaning unit, wherein the printhead is located in the capping zone of the cleaning unit.
Figure 5:
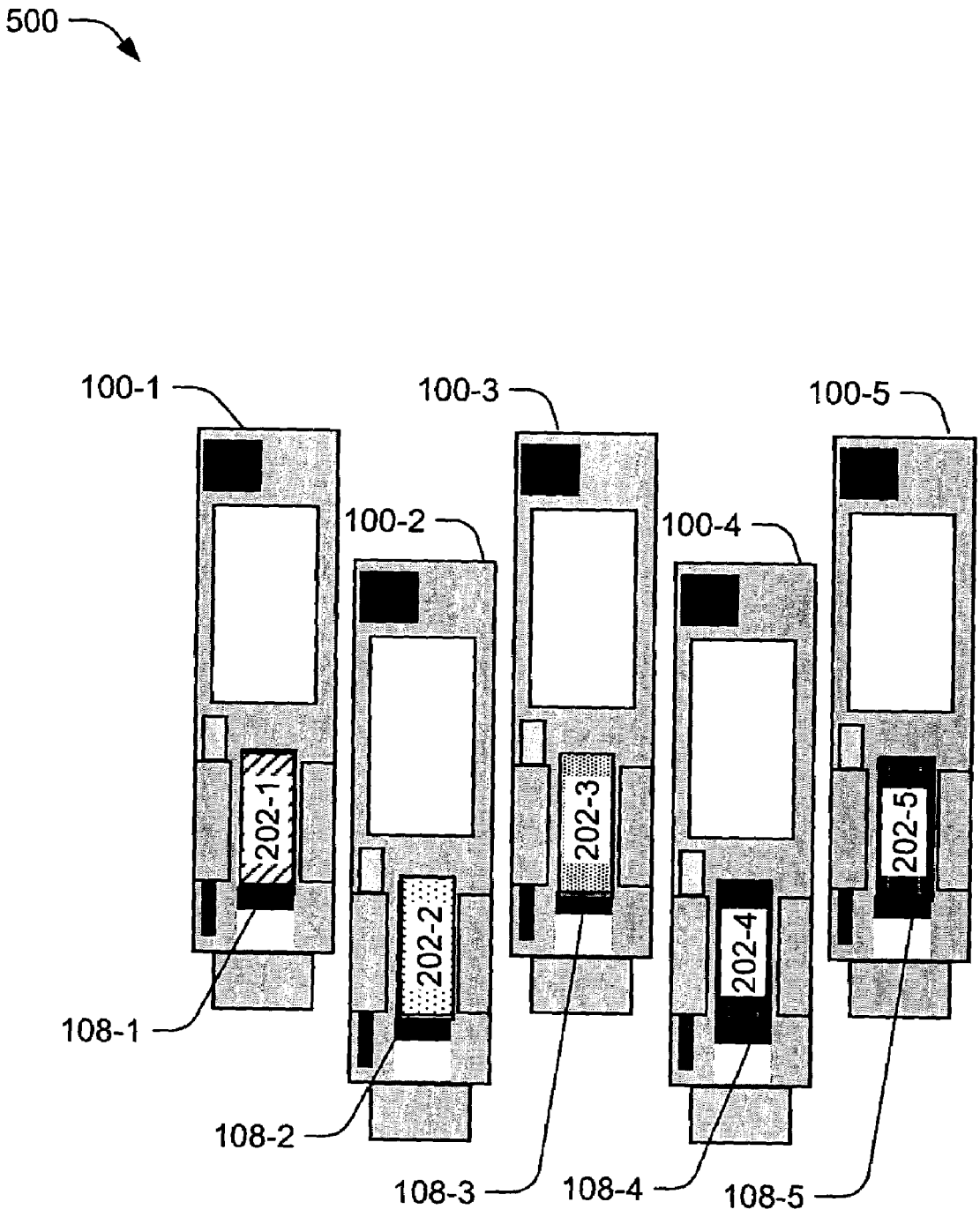
Fig. 5 (Prior Art)
FIG. 5 shows that an exemplary embodiment of a service station with five (5) conventional printhead cleaning units that are in a staggered configuration with respect to one another is inoperable.

FIG. 3 shows a side perspective of a latching mechanism 302 in an inkjet-imaging device for housing a printhead cleaning unit 100 (see, also FIGS. 1 and 5; any one of the cleaning units 100-1 through 100-4 of FIG. 5). A printhead 202 (any one of the printheads 202-1 through 202-4 of FIG. 2) is located in the capping zone 104 of the cleaning unit 100. The nozzle wiping mechanism 102 and the ink solvent dispensing nib mechanism 106 of the cleaning unit both project above the plane of the cleaning unit. Such a latching mechanism as well as other examples and procedures of conventional inkjet printhead service stations and printhead cleaner units are described in detail in U.S. patent application Ser. No. 3,135,585, assigned to the assignee hereof, and hereby incorporated by reference.

Figure 4:
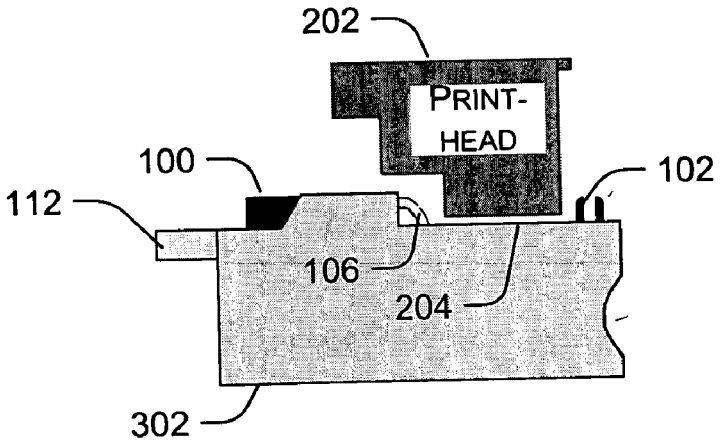
Fig. 4 (Prior Art)
FIG. 4 is a side perspective of a conventional latching mechanism in an inkjet-imaging device for housing an existing printhead cleaning unit, wherein the printhead is located in the print zone.

FIG. 4 is a side perspective of a latching mechanism 302 in an inkjet-imaging device for housing a printhead cleaning unit 100 (see, also FIGS. 1 and 5). The printhead 202 is located in a print zone 204 (e.g., the print zone 204 of FIG. 2). The print zone is the zone wherein print media is imaged upon by the printhead. See also, FIG. 3 discussed above, and FIG. 7, which is discussed below, to further illustrate the relative motion of the printheads with respect to the cleaning units.

In view of the information gained from FIGS. 1–4, we now describe why conventional inkjet imaging device printhead service station designs do not provide for cleaning units that can service printheads that are in a staggered configuration. That is, we describe in detail why conventional printhead cleaning unit designs do not provide uninhibited movement of printheads from the capped position to the print zone position. Referring to FIG. 5, a service station 500 with five printhead cleaning units 100 that are in a staggered configuration with respect to one another is shown. Each cleaning unit 100 is illustrated in a capping position with respect to a particular printhead 202-1 through 202-5 at a respective capping station 108. FIG. 6 illustrates that when an attempt is made to move respective ones of the five printheads 202 from respective capping stations 108 to respective spittoon reservoirs 104, and into to a print zone 604, four of the five printheads (e.g., printheads 202-1 through 202-4) collide with portions 602-1 through 602-4 of an adjacent cleaning unit 100.

For example, as the magenta ink dispensing printhead 202-1 is moved from the spittoon 104-1 towards the print zone 604, the magenta printhead collides with an adjacent nozzle-wiping unit—as illustrated in the respective circled areas 602 of cleaning unit 100-2. The circled region 602-1 illustrates this collision. (Nozzle wiping units 102 are shown in detail in FIGS. 1 and 3). In another example, as the yellow ink dispensing printhead 202-2 is moved from the spittoon 104-2 towards the print zone 604, a yellow printhead collides with the solvent dispensing nib (see also nib 106 of FIG. 1) of the cleaning unit 100-2. The circled region 602-2 illustrates this particular collision. In yet another example, as a cyan ink dispensing printhead 202-3 is moved from its respective spittoon towards the print zone 904, the printhead collides with the wiper unit of the adjacent cleaning unit 100-3. The circled region 602-3 illustrates this respective collision. As the black ink dispensing printhead 202-4 is moved from its respective spittoon towards the print zone 604, the black printhead collides with the wiper unit of the adjacent cleaning unit 100-4. The circled region 902-4 illustrates this particular collision.

As shown in FIG. 6, the only printhead that does not collide with a portion of an adjacent printing unit 100 is the second black ink dispensing printhead 202-5. This is because there is no staggered cleaning unit situated adjacent to the path of the printhead in the direction of the printing zone 604. However, since the carriage physically joins the five printheads into a single physical component, and because adjacent printhead cleaner components block four of the five printheads from the print zone, not even a single printhead can make it into the print zone. Thus, the imaging device is unable to form a proper image on any print media.

Figure 8:
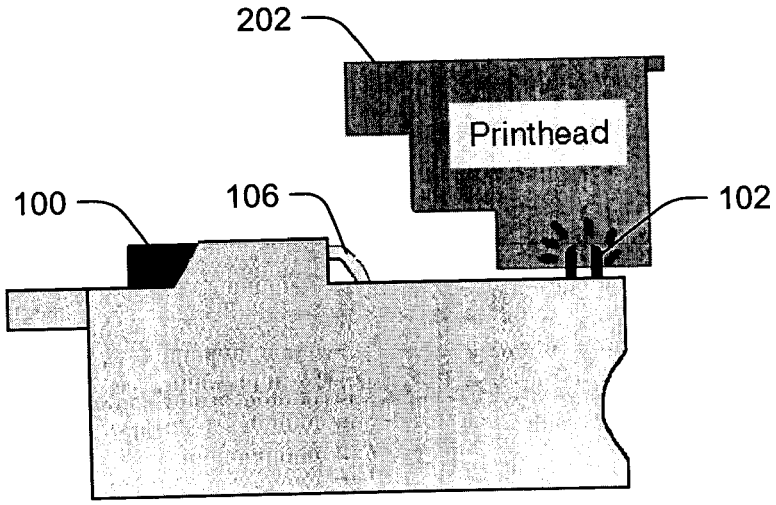
Fig. 8 (Prior Art)
FIG. 8 shows a collision of a printhead with a nozzle-wiping unit attached to a conventional cleaning unit positioned adjacent to the printing unit used to service the printhead.

FIGS. 7 and 8 further illustrate aspects of collisions that a conventional printhead 202 in a staggered configuration with respect to other printheads experiences while moving in the direction of a printing zone. Specifically, FIG. 7 shows a collision of a printhead 202 with a nib 106 attached to a cleaning unit 100 positioned adjacent to the printing unit used to service the printhead. FIG. 8 shows a collision of a printhead 202 with a nozzle-wiping unit 102 attached to a cleaning unit 100 positioned adjacent to the printing unit used to service the printhead.

An Exemplary Single Actuation Axis Printhead Cleaning Architecture

Figure 9:
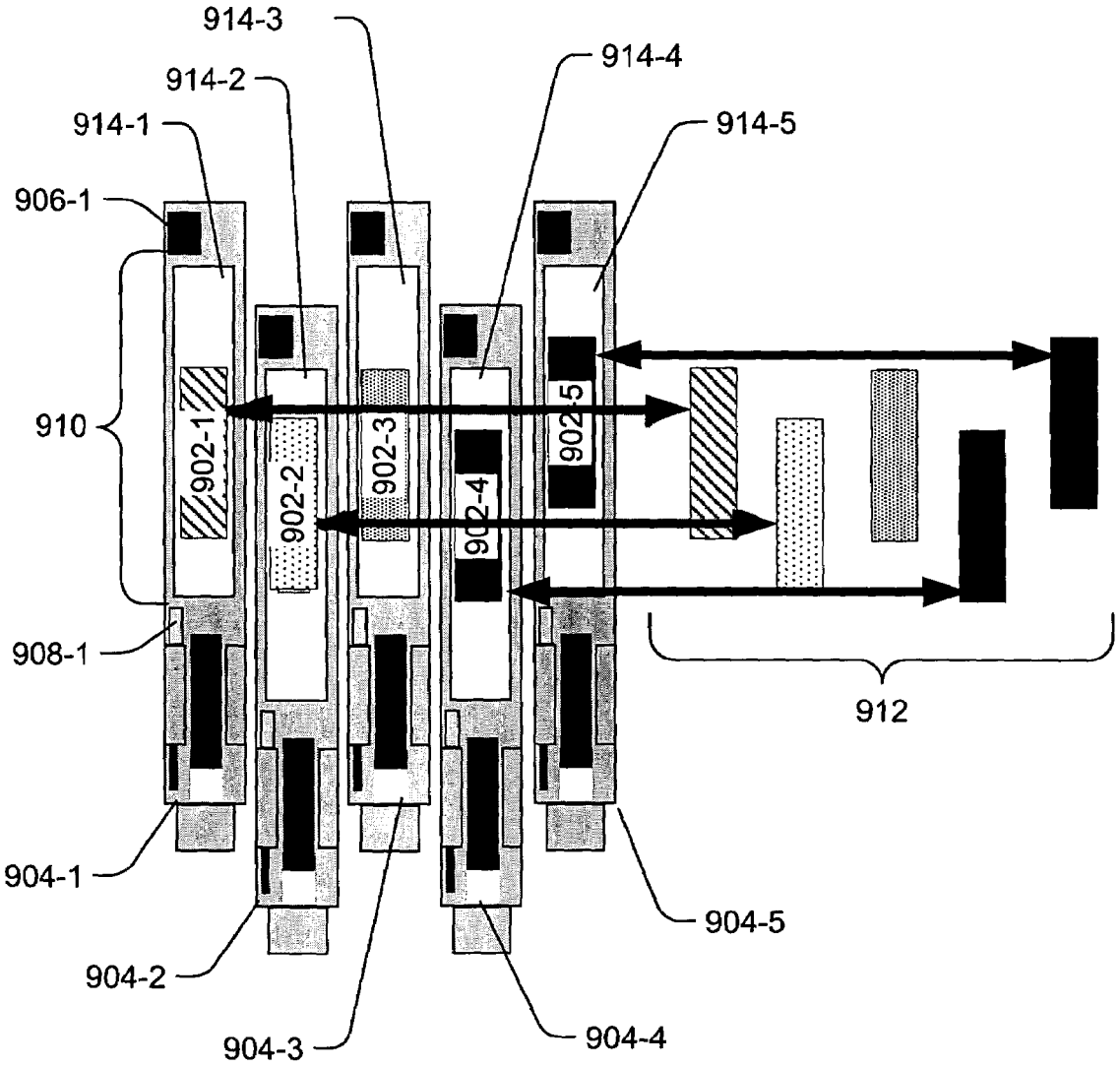
FIG. 9 shows an exemplary embodiment of a solution to the printer head and adjacent cleaning unit collision problem encountered in a staggered printhead configuration.

FIG. 9 shows an exemplary embodiment of a printhead cleaning architecture that solves the problems with the conventional printhead cleaning architectures (e.g., the conventional architectures of FIGS. 1–8). A distance 910 separates the wiper 906 and nib 908 such that there is enough room for staggered printheads to move to a print zone 912 without colliding with portions of adjacent cleaning units. As illustrated by the arrows representing movement between the magenta ink printhead 902-1 in the spittoon 914-1 and the corresponding printhead in the print zone 912, there is enough room for the printhead to move from the spittoon to the print zone without colliding with the wiper 906 of adjacent cleaning unit 904-2. Additionally, as illustrated by the arrow representing the movement between a yellow ink printhead 902-2 in the spittoon 914-2 and the corresponding printhead in the print zone 912, there is enough room for the printhead to move from the spittoon to the print zone without colliding with the wiper 906 of adjacent cleaning unit 904-3, etc.

Accordingly, collective movement of one or more the printheads 902 to the print zone 912 is along a single, unbroken, and substantially straight path—a single actuation axis. This printhead movement is not segmented orthogonal to the single straight path shown by the arrows. (The term "substantially" in the previous sentence means that non-programmed/designed anisotropic movements resulting from differential machining of imaging device components from ideal specification may occur). The exemplary solution of FIG. 9 provides means for servicing a staggered printhead configuration without causing the printheads to collide with portions of adjacent cleaning units. However, this solution can be modified to reduce the printhead servicing station footprint and corresponding large printhead cleaner units 904.

Figure 10:
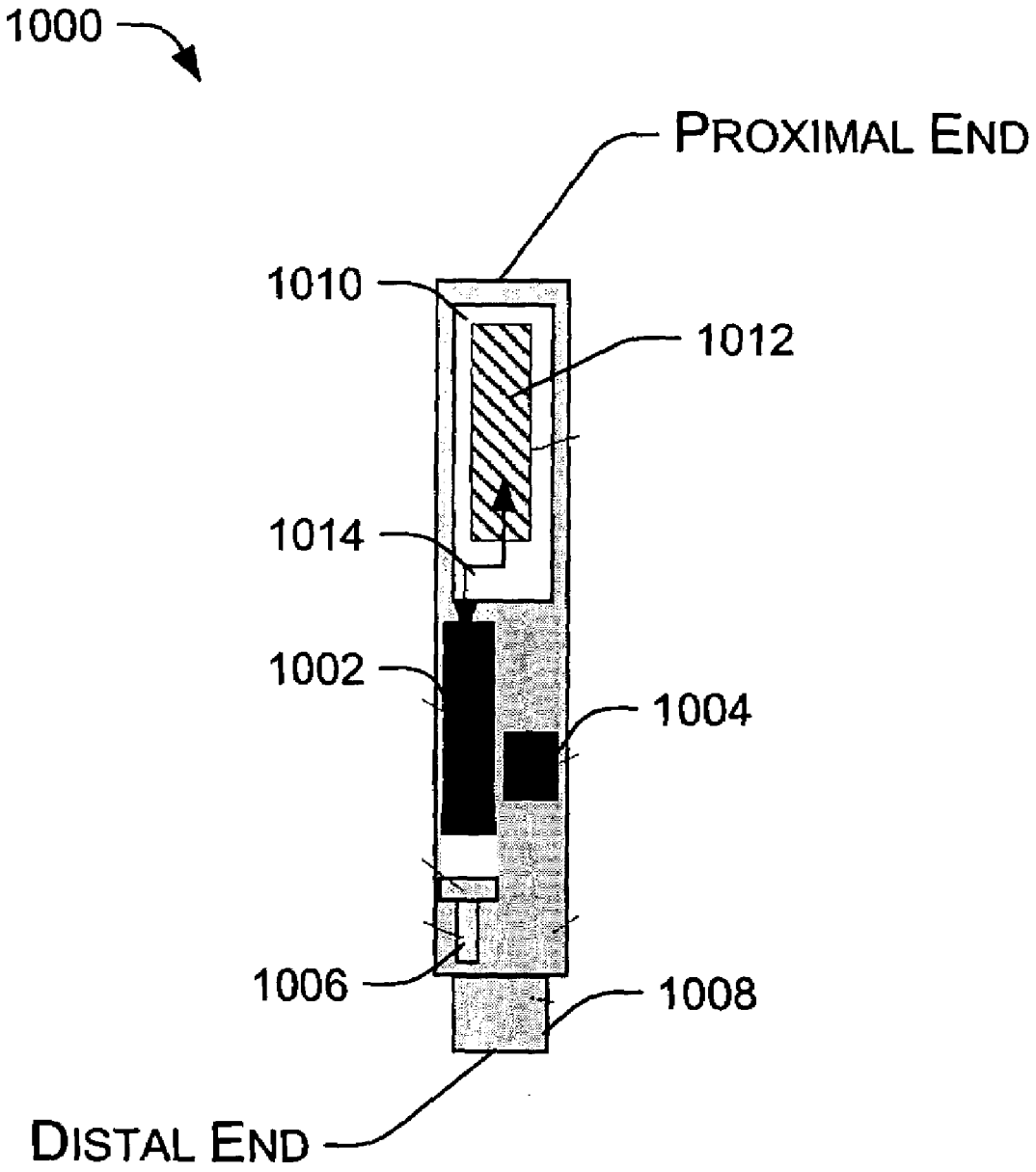
FIG. 10 shows an exemplary embodiment of a top view of printhead-cleaning unit configured to service a printhead that is in a staggered printhead configuration.

FIG. 10 shows a top view of an exemplary embodiment of a printhead-cleaning unit 1000 configured to service a printhead 1012 that is in a staggered printhead configuration in an imaging device (e.g., see, the staggered printhead configuration of FIG. 9). More particularly, cleaning components 1002 through 1010 are substantially optimally positioned on the cleaning unit 1000 such that when the printhead 1012 moves to/from-servicing aspects of the cleaning unit (e.g., to/from the spittoon area 1010), the printhead 1012 will not collide with components of any other cleaning unit 1000 (e.g., an adjacent cleaning unit 1000).

The exemplary printhead cleaning unit 1000 allows for generation of a smaller service station footprint as compared to the footprint that results in a similar printhead configuration using cleaning units of FIG. 9. The capping unit 1002 of the cleaning unit is located off center with respect to the cleaning unit's body. This allows positioning of the nozzle-wiping unit 1004 adjacent to the capping unit as shown. The ink solvent dispensing nib 1006 is located at the proximal end of the capping unit nearest the handle 1008. The zigzag arrow 1014 shows the relative motion of the printhead to/from the capping unit 1002 relative to the position of the spittoon reservoir 1010.

Figure 11:
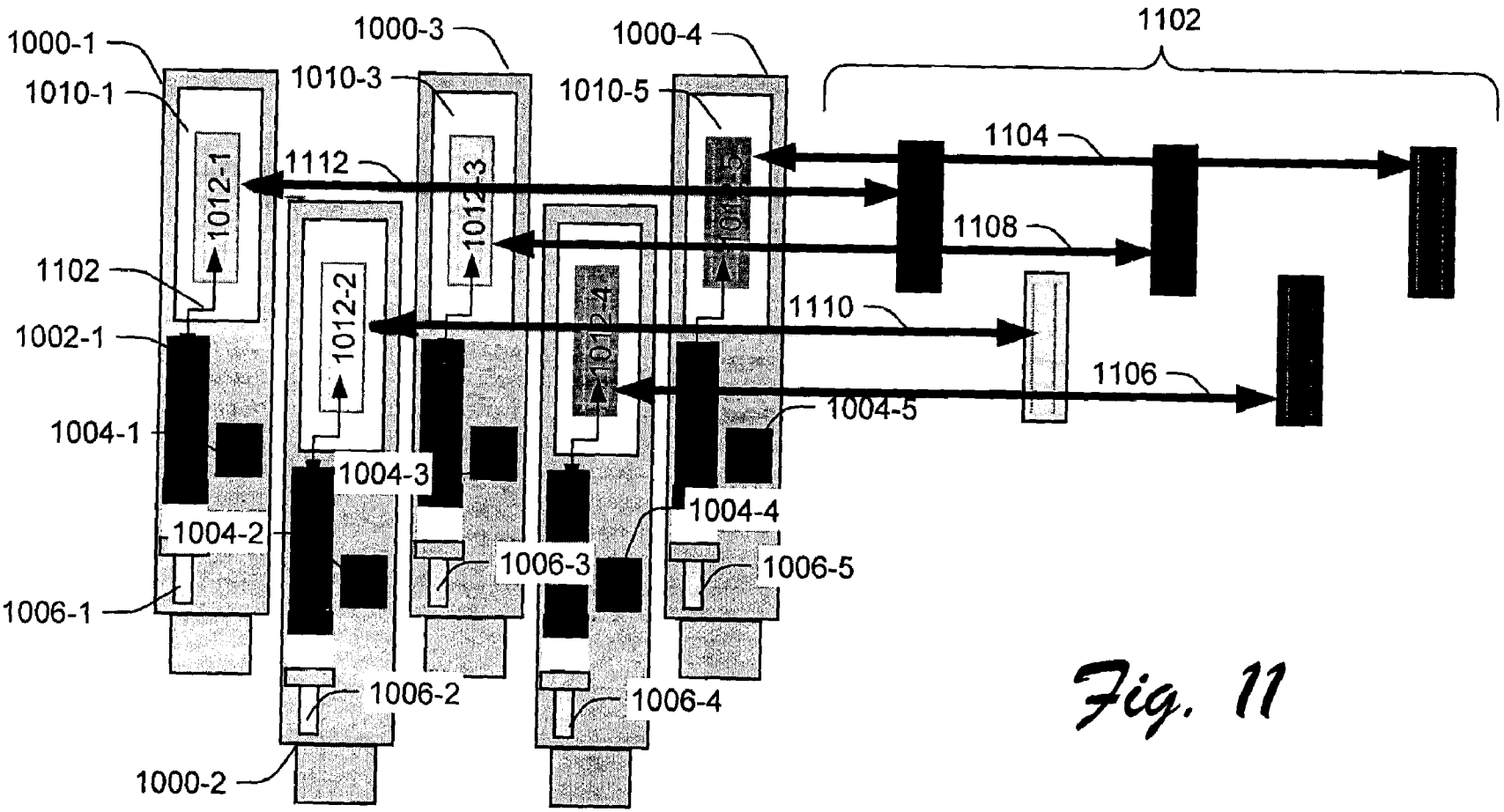
FIG. 11 shows an exemplary embodiment of five printhead cleaning units that are configured to service printheads in a staggered configuration. Zigzag arrows represent each printhead's motion from a respective capping unit to a related spittoon.

FIG. 11 shows the configuration of five printhead cleaning units 1000 of FIG. 10 used to service staggered printheads 1012. The respective zigzag arrows between capping units and spittoon regions represent printhead 1012 motion from a respective capping unit to a related spittoon 1010. For instance, zigzag arrow 1102 represents the relative motion of printhead 1012-1 from capping unit 1002-1 to related spittoon 1010-1. As shown by the bold horizontally positioned arrows 1104 through 1112, each staggered printhead has unhindered access to/from the cleaning units to/from the print zone 1102. In other words, a printhead has a single actuation axis that does not intersect with any component (e.g., a wiper or nib) of an adjacent cleaning unit.

Although the example of FIG. 11 uses five cleaning units 1000 and five corresponding printheads 1012 to describe a printhead cleaning architecture for staggered printheads, any number of printheads and cleaning units can be used. For example, two cleaning units and two staggered printheads would benefit from the description herein. Additionally, a single cleaning unit and a single printhead that includes Cyan, Magenta, Yellow, and Black (CMYK) ink nozzles would benefit from the description herein because the imaging device's footprint is relatively smaller. Moreover, although certain ones of the FIGS. 9–11 have been described as having particular printheads for specific types of ink color, any type of ink color, as a function of the imaging algorithm(s) utilized, can be substituted for the exemplary embodiments.

Figure 12:
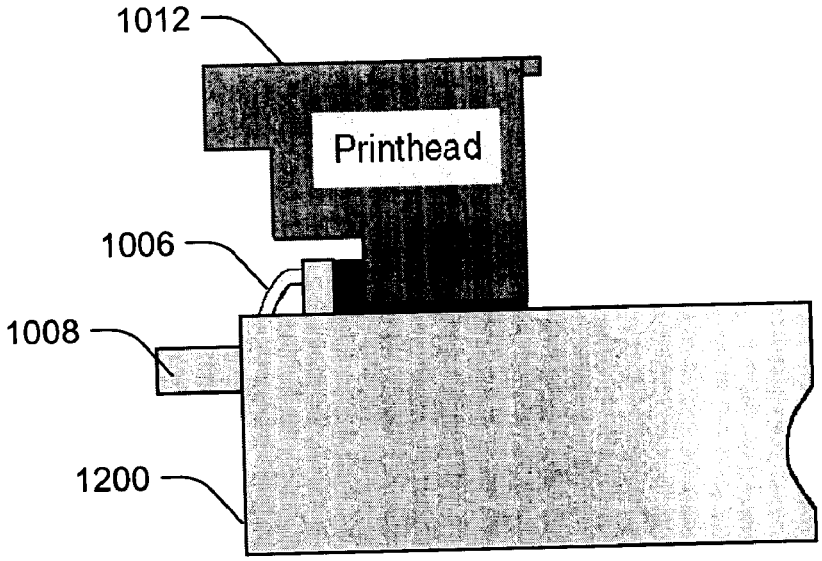
FIG. 12 shows an exemplary embodiment of a side view perspective of a printhead service station and a printhead in the capping position.
Figure 13:
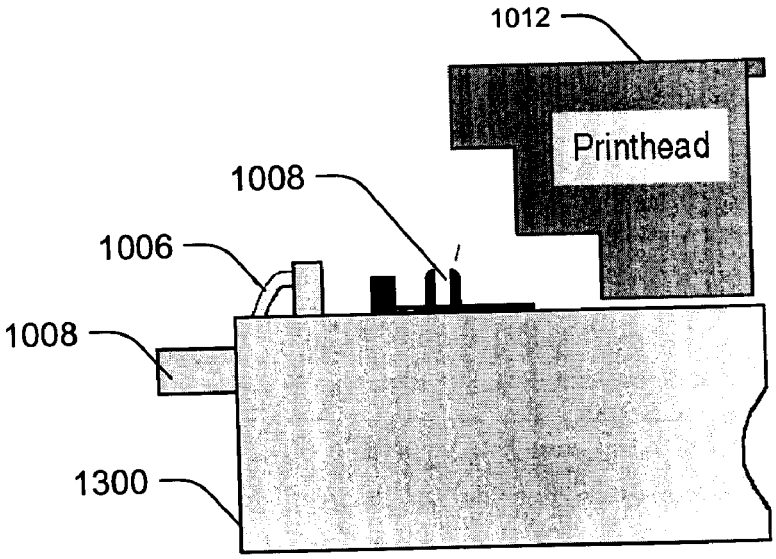
FIG. 13 shows an exemplary embodiment of a side view perspective of a printhead service station and a printhead in the spitting position.
Figure 14:
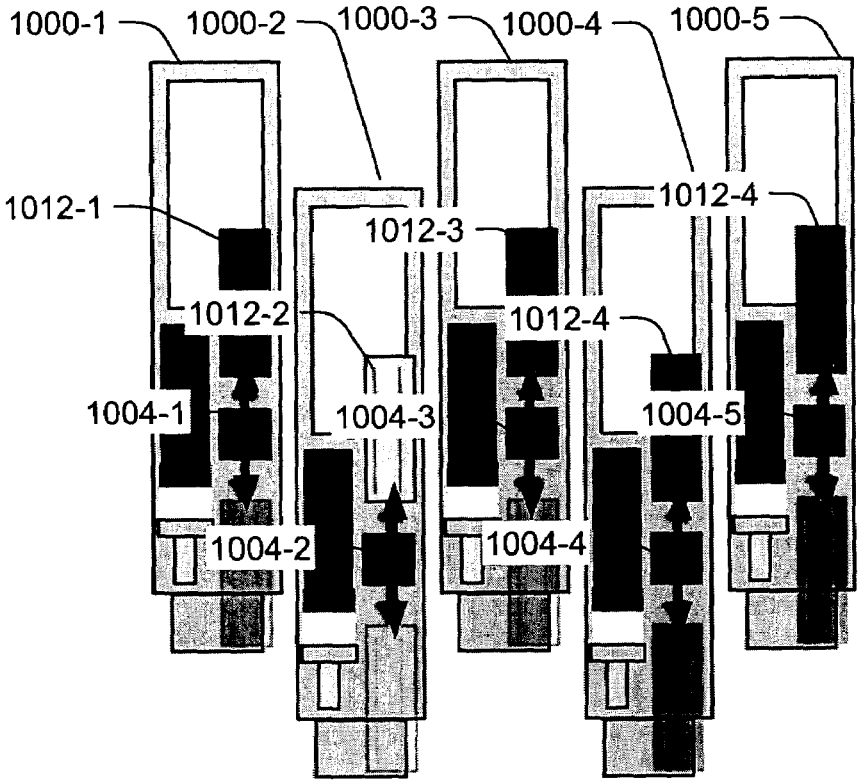
FIG. 14 shows an exemplary embodiment of a top view of a number of printhead cleaners being used by a number of staggered printheads to service corresponding ink nozzles by wiping them across respective wiping units. The bolded arrows positioned at the proximal end of each printhead and which trend across respective wiping units show relative motion of the printheads with respect to the wiping units.
Figure 15:
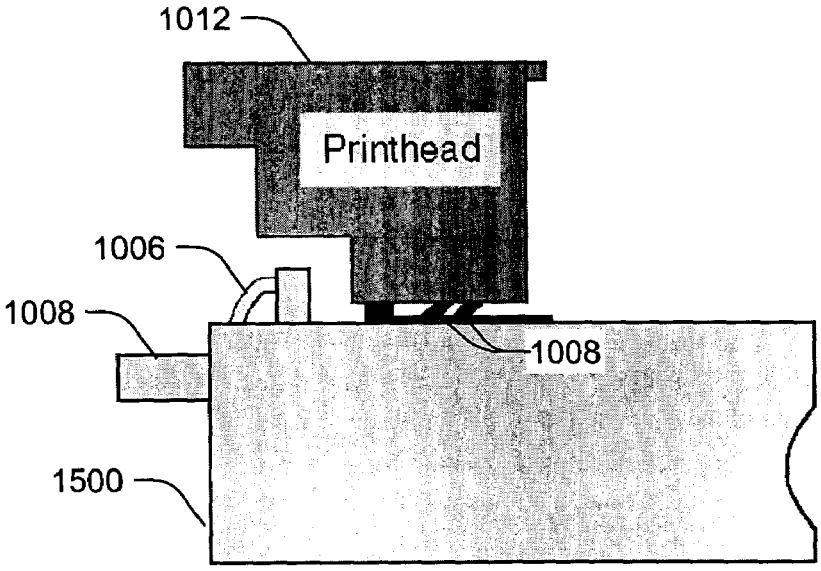
FIG. 15 is an exemplary embodiment of a side view of a printhead serviced by a wiping unit.
Figure 16:
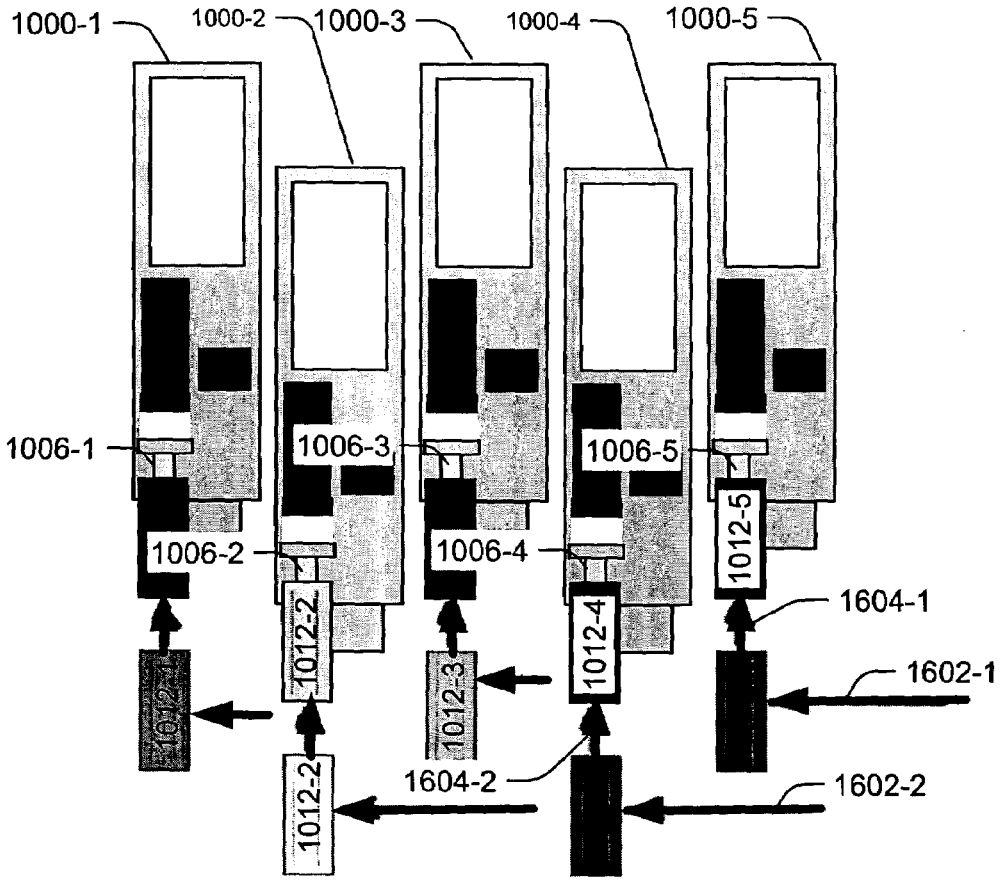
FIG. 16 shows an exemplary embodiment of a top view of a number of printhead cleaners used by a number of staggered printheads to gather ink solvent at respective solvent nibs 1006.
Figure 17:
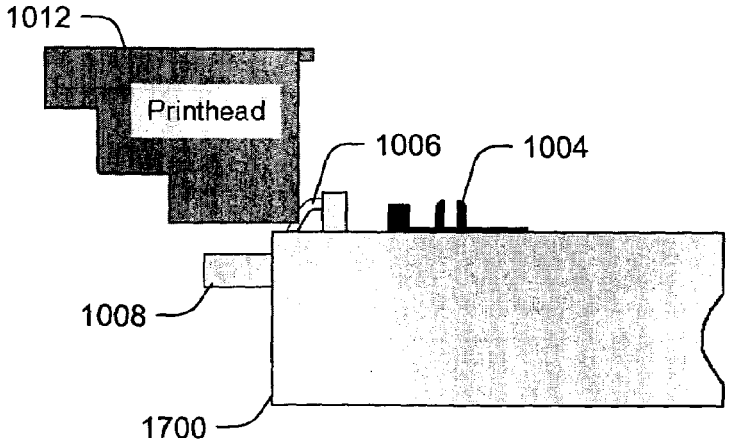
FIG. 17 is an exemplary embodiment of a side view of a printhead being serviced by an ink solvent nib.

FIGS. 12 through 17 show exemplary block diagrams of various printhead service functions with respect to the cleaning unit 1000 of FIG. 10. In particular, FIG. 12 shows a side view perspective of a printhead service station 1200 and a printhead 1012 in the capping position (e.g., see the capping unit 1002 of FIGS. 10 and 11). FIG. 13 shows a side view perspective of a printhead service station 1300 and a printhead 1012 in the spitting position (e.g., see the spittoon unit 1010 of FIGS. 10 and 11). FIG. 14 shows a top view of a number of printhead cleaners 1000 used by a number of staggered printheads 1012 to service corresponding ink nozzles by wiping them across respective wiping units 1004. The bolded arrows positioned at the proximal end of each printhead and which trend across respective wiping units show relative motion of the printheads with respect to the wiping units. FIG. 15 is a side view of a printhead 1012 serviced by a wiping unit 1008. FIG. 16 shows a top view of a number of printhead cleaners 1000 used by a number of staggered printheads 1012 to gather ink solvent at respective solvent nibs 1006. In this example, the printheads move from the print zone (not shown) along a single actuation axis, as represented by the horizontal arrows (e.g., arrows 1602). After aligning each printhead with its corresponding nib, the printhead moves to the nib as shown by the vertical bolded arrows (e.g., arrows 1604). FIG. 17 is a side view of a printhead 1012 being serviced by an ink solvent nib 1006.

Exemplary Imaging Device For Servicing Staggered Printheads

Figure 18:
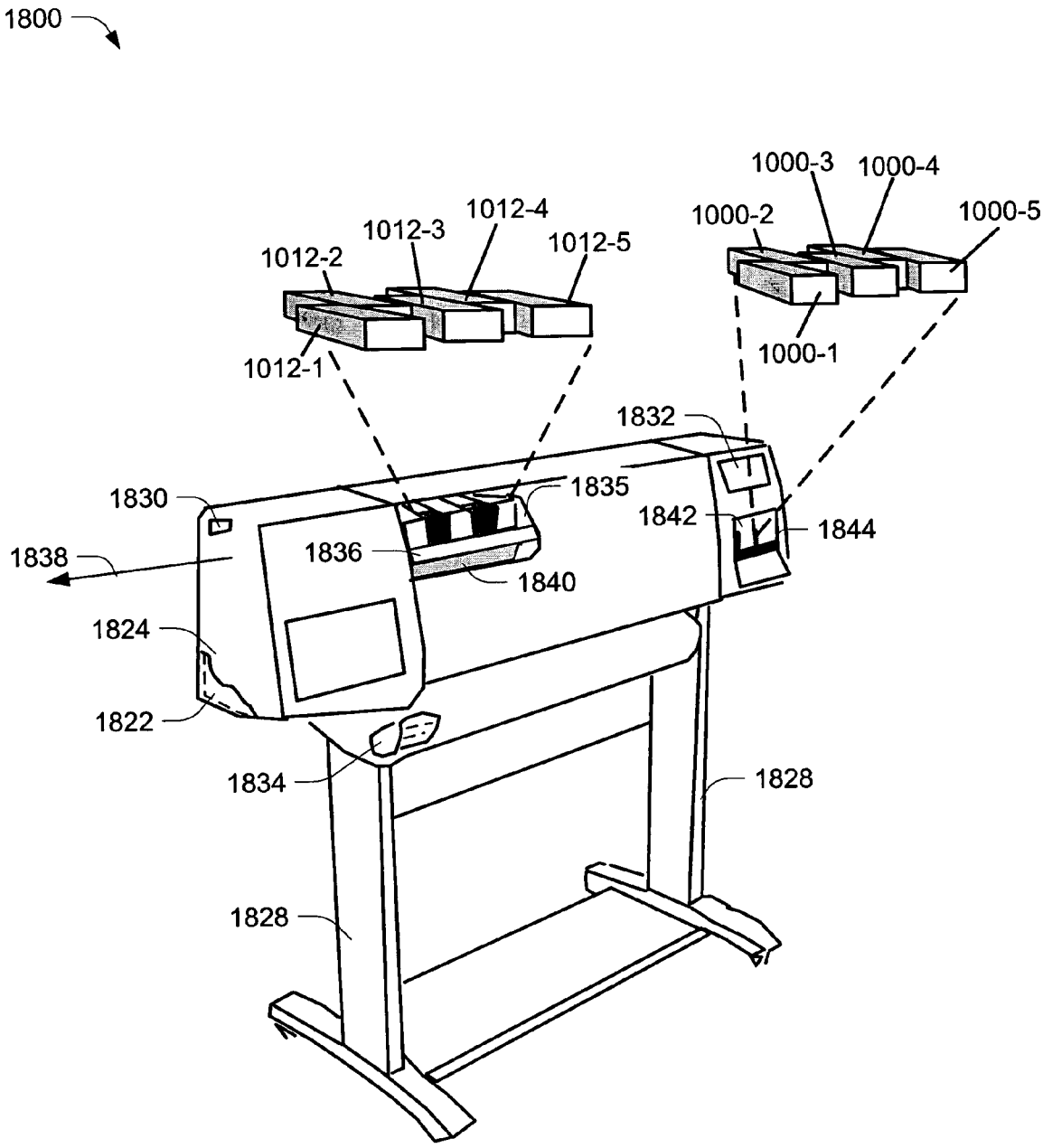
FIG. 18 is an exemplary embodiment of a perspective view of one form of an inkjet-imaging device, here an inkjet plotter, including one form of a replaceable inkjet printhead cleaner service station system, shown here to service a set of single actuation axis staggered inkjet printheads.

FIG. 18 is a perspective view of an exemplary embodiment of an inkjet-imaging device 1800, here an inkjet plotter, including one form of a replaceable inkjet printhead cleaner service station system comprising cleaning units 1000-1 through 1000-5 to service a set of single actuation axis staggered inkjet printheads 1012. The imaging device may be used for printing engineering and architectural drawings, as well as high quality poster-sized images, and so on, in an industrial, office, home, or other environment. Although the imaging device is described in this example as an inkjet plotter, the component single actuation axis printhead cleaning architecture of staggered printheads could also have been shown as being implemented in a different device, such as a desktop printer, portable printer, copier, camera, video printer, facsimile machine, etc.

The inkjet plotter 1800 includes a chassis 1822 surrounded by housing or casing enclosure 1824 such as a plastic material, together forming a print assembly portion of the plotter. A desktop, tabletop, or leg assemblies 1828 may support the print assembly portion. The plotter has a plotter controller, illustrated schematically as processor 1830 that receives instructions from a host device, typically a computer, such as a personal computer, a server, a laptop computer, a computer aided drafting (CAD) computer system, and/or the like. The plotter controller may also operate in response to user inputs provided through a keypad and status display portion 1832, located on the exterior of the casing 1824. A monitor (not shown) coupled to the computer host (not shown) may also be used to display visual information to an operator, such as the plotter status or a particular program being run on the host computer.

A conventional print media handling system (not shown) may be used to advance a continuous sheet of print media 1834 from a roll through a print zone 1835. The print media may be any type of suitable material such as paper, poster board, fabric, transparencies, Mylar®, and so on. A carriage guide rod 1836 is mounted to the chassis 1822 to define a scanning axis 1838 with the guide rod 1836 slideably supporting an inkjet carriage 1840 for travel back and forth, reciprocally, across the print zone 1835. A conventional carriage drive motor (not shown) may be used to propel the carriage 1840 in response to a control signal received from the controller 1830. To provide carriage positional feedback information to controller 1830, a conventional metallic encoder strip (not shown) may be extended along the length of the print zone 1835 and over the servicing region 1842. A conventional optical encoder reader may be mounted on the back surface of printhead carriage 1840 to read positional information provided by the encoder strip. The manner of providing positional feedback information via the encoder strip reader may also be accomplished in a variety of ways known to those skilled in the art.

Upon completion of printing an image, the carriage 1840 may be used to drag a cutting mechanism (not shown) across the final trailing portion of the media to sever the image from the remainder of the roll 1834. The illustrated inkjet printing mechanism may also be used for printing images on pre-cut sheets, rather than on media supplied in a roll 1834.

In the print zone 1835, the media sheet receives ink from an inkjet printhead 1012 or cartridge, such as one or more black ink cartridges and three monochrome color ink cartridges (e.g., see FIGS. 9 and 11). The printheads are in a staggered configuration with respect to one another as shown. Color printheads 1012 are described as each containing a dye-based ink of the colors yellow, magenta and cyan, respectively, although the color pens may also contain pigment-based inks. Other types of ink may also be used in the pens such as paraffin-based inks, as well as hybrid or composite inks having both dye and pigment characteristics. The illustrated plotter 1820 uses an "single actuation-axis service station", ink delivery system having main stationary reservoirs (not shown) for each ink (black, cyan, magenta, yellow) located in an ink supply region 1858 system. A single actuation axis means that the service station only moves in a single direction (e.g., back and forth), in contrast to dual-axis movement that requires additional up and down or lateral motion.

The printheads 1012 are replenished by ink conveyed through a conventional flexible tubing system (not shown) from stationary main reservoirs, so only a small ink supply is propelled by carriage 1840 across the print zone 1835, which is located "off-axis" from the path of printhead travel. As used herein, the term "printhead", "pen" or "cartridge" may also refer to replaceable printhead cartridges where each pen has a reservoir that carries the entire ink supply as the printhead reciprocates over the print zone. The printheads 1012 each have an orifice plate (not shown) with a plurality of nozzles formed there through in a manner well known to those skilled in the art. The printheads are thermal inkjet printheads, although other types of printheads may be used, such as piezoelectric printheads. The thermal printheads typically include a plurality of resistors, which are associated with the nozzles. Upon energizing a selected resistor, a bubble of gas is formed which ejects a droplet of ink from the nozzle and onto a sheet of paper in the print zone 1835 under the nozzle. The printhead resistors are selectively energized in response to firing command control signals delivered from the controller 1830 to the printhead carriage 1840.

The printheads are serviced or cleaned by a service station 1844 that includes a number of printhead cleaning units 1000. Recall that conventional printhead-cleaning units (e.g., the printheads 100 of FIGS. 1 and 5) do not provide servicing of printheads in a staggered configuration without undesired collisions between the printheads and portions of adjacent cleaning units, as further illustrated via FIGS. 6–8. In contrast to these conventional printhead-cleaning units, the single actuation axis framework of the imaging system 1800 provide for servicing of staggered printheads is a manner that is free of undesired collisions and in a manner that provides a substantially small servicing station footprint.

Figure 19:
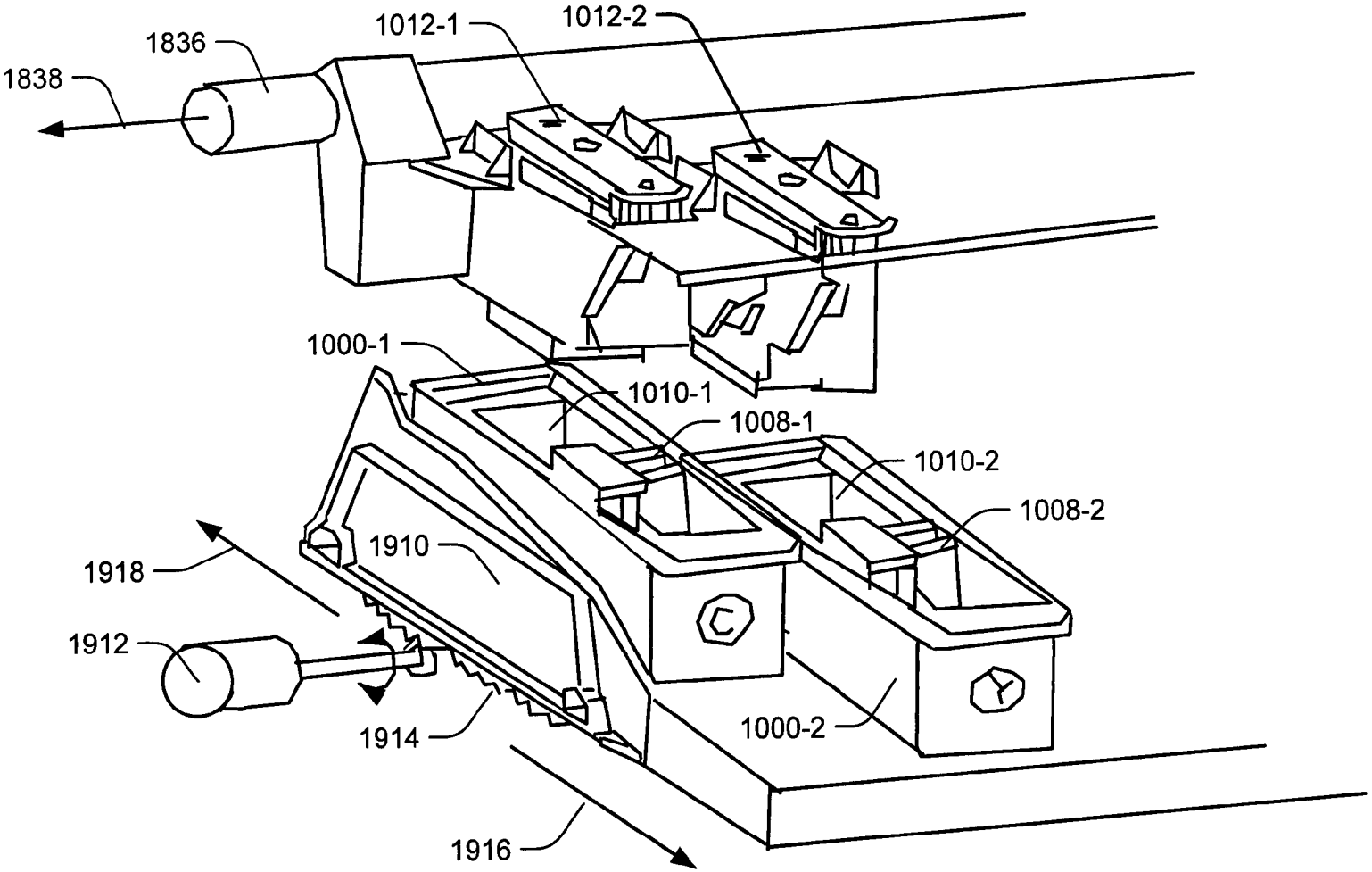
FIG. 19 is an exemplary embodiment of an enlarged perspective view of the replaceable service station prior to servicing the printheads.

FIG. 19 is an enlarged perspective view of the replaceable service station 1844 prior to servicing the printheads 1012. The service station includes a translationally moveable pallet 1910, which is selectively driven by a motor 1912 through a rack and pinion gear 1914 assembly in a forward direction 1916 and in a rearward direction 1918 in response to a drive signal received from the controller 1830. The service station 1844 includes five replaceable inkjet printhead cleaner units 1000-1 through 1000-5 in a staggered configuration for servicing the respective printheads 1012-1 through 1012-5. Any number of such printing units could be used in this architecture as a function of the imaging algorithm utilized. For purposes of illustration, only units 1000-1 and 1000-2 are shown. Note that printhead 1012-2 is in a more forward position, or offset as compared to printhead 1012-1. This offset of the printheads is referred to as a "stagger" configuration. Each of the cleaner units includes an installation and removal handle 1008 (FIG. 10), which may be gripped by an operator when installing the cleaner units in their respective staggered chambers or stalls as defined by the service station pallet 1910. Following removal, the cleaning units are typically disposed of and replaced with a fresh unit, so the units may also be referred to as "disposable cleaning units".

An Exemplary Printhead Servicing Module

Figure 20:
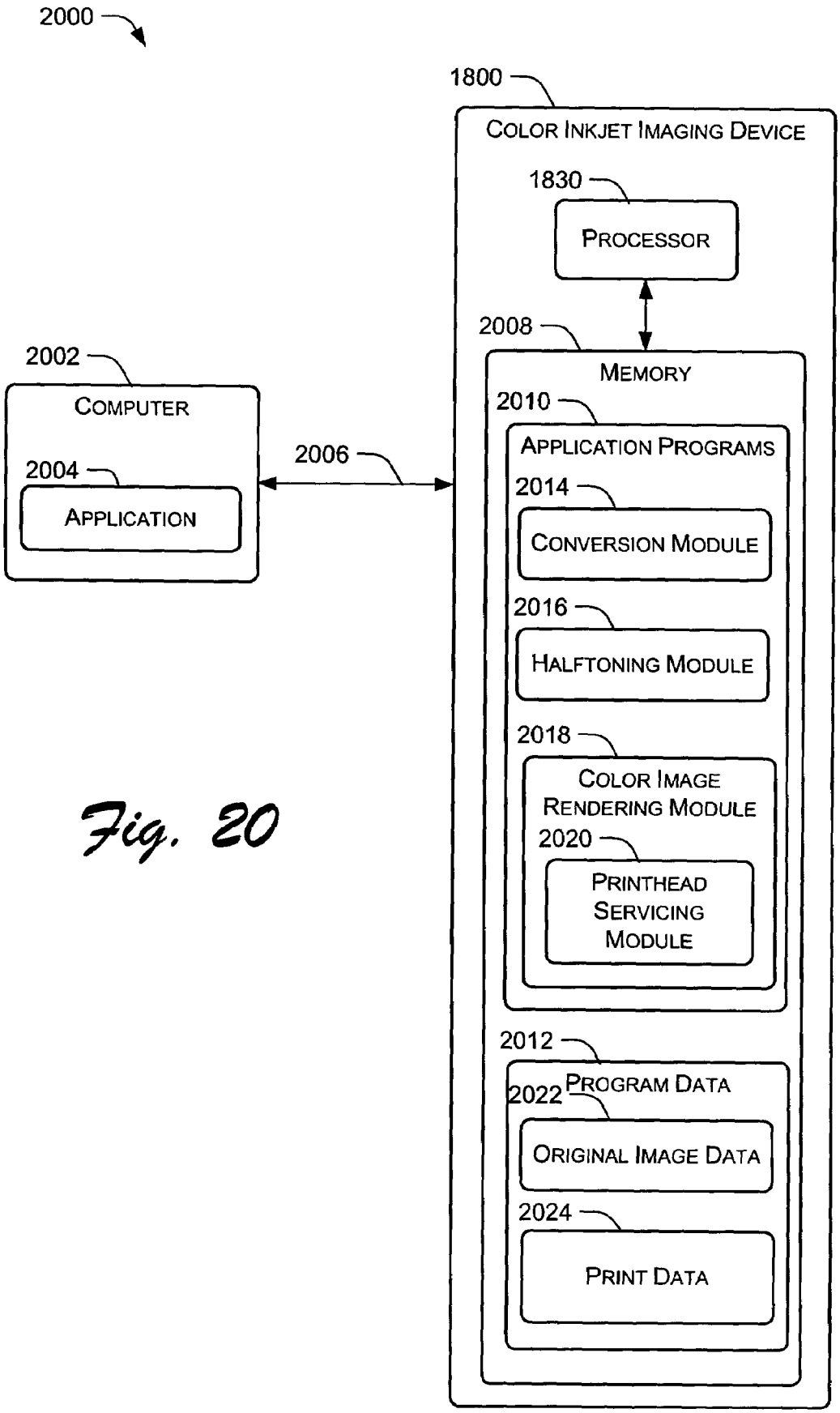
FIG. 20 is a block diagram that shows an exemplary embodiment of a system to service staggered printheads.

FIG. 20 shows an exemplary system 2000 to service staggered printheads. The system is operational with numerous general or special purpose computing system environments or configurations. For example, the system includes a host computer 2002 coupled to a color-imaging device 1800 of FIG. 18. The host computer is any type of computing device such as a personal computer, workstation, server, mainframe, image copier, image scanner, video camera, or other device that is configured to communicate with image forming devices. The computer 2002 operates in accordance with computer-program instructions associated with at least one application 2004 that outputs image data (e.g., the image data 2022 portion of program data 2012) representing a color image suitable for subsequent use by the imaging device 1800. The application 2004 represents one or more sets of software instructions and can include operating system instructions, user application instructions, communication instructions, peripheral driver instructions, color image generation, and/or color image manipulation instructions, and any other instructions required to operate the computer within the color imaging system 2000. The application is provided in one or more conventional memories (not shown) that are read or otherwise accessed by the computer.

The computer 2002 is connected to the imaging device 1800 via data communications path 2006. The data communications link includes requisite communication resources to transport image data and control data between the computer and the imaging device. For example, the communication path may include one or more interface connections, local area networks (LANs), wide area networks (WANs), intranets, the Internet, or other like communication networks, services, and/or systems.

As discussed above in reference to FIG. 18, and as also shown herein in FIG. 20, imaging device 1800 includes a processor 1830 configured to control the operations associated with various subsystems and computer-program modules therein while forming color images on print media. Specifically, the processor is coupled to a memory 2008 that includes computer program applications 2010 and program data 2012. Exemplary memories include nonvolatile memory (e.g., flash memory, EEPROM, and/or read-only memory (ROM)), random access memory (RAM), and hard disk and associated drive circuitry.

The processor 1830 is configured to fetch and/or read computer-executable instructions 2010 and/or data 2012 respectively to/from the memory 2008 to render color images. The computer-executable instructions include an image data conversion module 2014, a halftoner module 2016, and a printing module 2018. The printing module includes a printhead-servicing module 2020 to move staggered printheads (e.g., printheads 1012 of FIGS. 9 and 11) to/from the print zone (e.g., print zone 1102 of FIG. 11, and print zone 1835 of FIG. 18) from/to a printhead servicing module (e.g., see service module 2020 of FIG. 20, and service module 1844 of FIG. 18). These movements are along a single actuation axis between the printheads and servicing module. Although these modules are described separately these module can be combined in any number of different program module combinations.

Image data 2020 is received from the computer 2002 over communication path 2006, and provided to the conversion module 2014. Color image data typically includes one or more various image objects such as text objects, graphics objects, and/or raster data objects, as defined by conventional desktop publishing techniques and/or tools. In this example, the color image data is in RGB data format. However, the exemplary arrangements and procedures of this description to move staggered printheads between a print zone and a printhead servicing module can be applied to image data received from a computer that is in data formats other than RGB, such as CMYK data formats, and so on. If the image data 2020 from the computer 2002 is not already in a printable data format, the image data conversion module 2014 uses a color table (not shown) to convert the color image data into corresponding print image data 2024 that is output to the halftoning module 2016. The print data includes 8-bits of data for each ink color (i.e., cyan (C), magenta (M), yellow (Y), and black (K)), for each pixel in the corresponding color image. Thus, 32-bits of print data define the overall color of each pixel in the print image.

Halftoning module 2016 renders gray levels of image data pixel color. Halftoning is a threshold operation to simulate a gray level by replacing some fraction of pixels with 0% ink and some fraction of pixels with 100% ink and some fraction of pixels with an intermediate level of ink. This produces a dot pattern at a resolution less than the pixel resolution of the printer. The halftoning module supplied the halftoned print data 2024 to the color image-rendering module 2018.

The printing module 2018 uses the print image data 2024 to selectively apply an appropriate amount of ink, such as, for example, cyan (C) ink, magenta (M) ink, yellow (Y) ink, or black (K) ink, to a print media to form a corresponding plane of printed image. Multiple staggered printheads (e.g., the printheads 1012 of FIG. 18) provide the ink. As the image is formed on the print medium, the printhead-servicing module 2022 moves the staggered printheads between a print zone and the imaging device's printhead servicing module.

An Exemplary Procedure to Service Staggered Printheads

Figure 21:
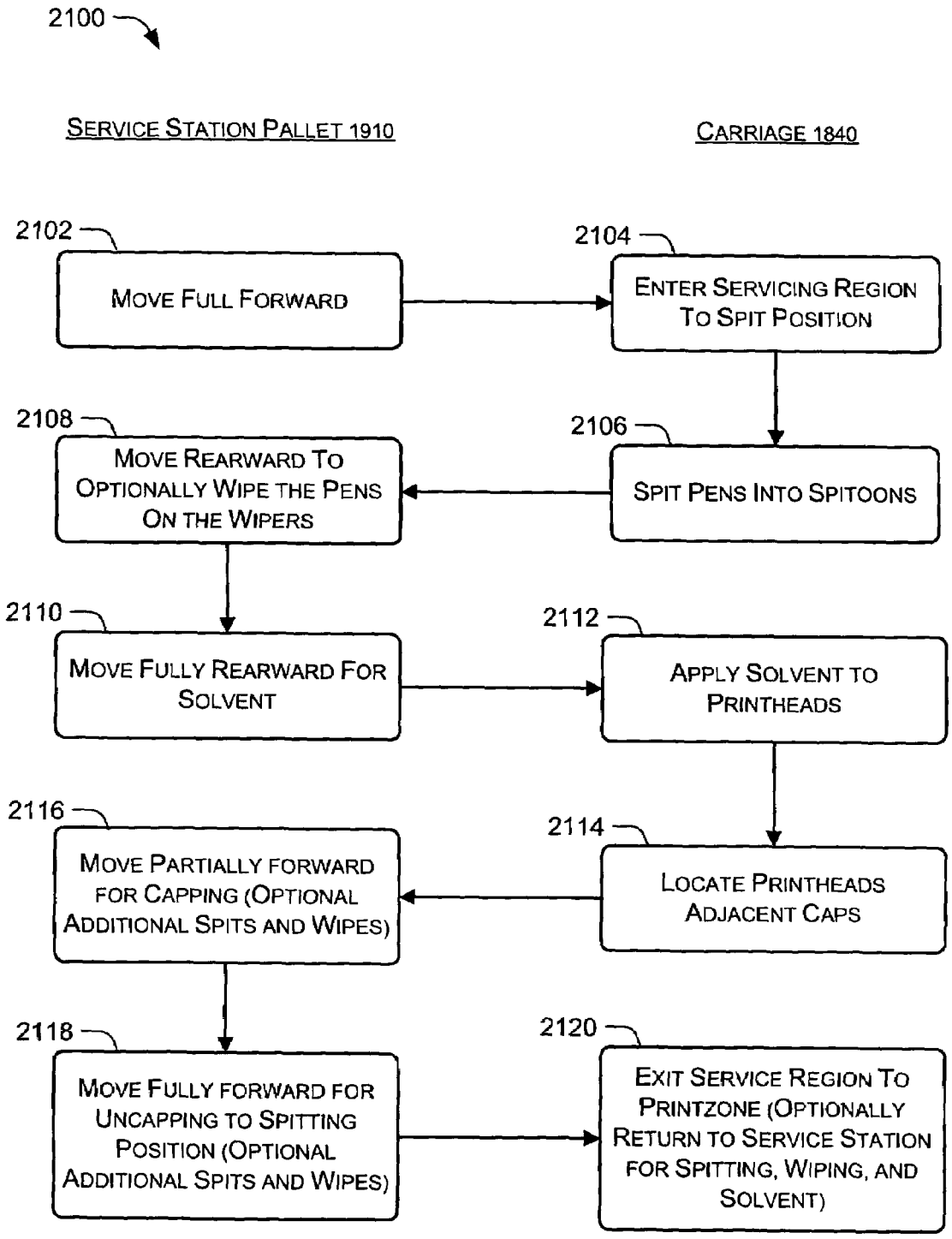
FIG. 21 is a flow diagram illustrating aspects of an exemplary embodiment of operation of the replaceable service station to service the staggered printheads installed in a carriage.

FIG. 21 is a flow diagram illustrating aspects of an exemplary operation of the replaceable service station 1000 to service the staggered printheads 1012 installed in carriage 1840. In the flow diagram of FIG. 21, the blocks in the left column all refer to motion of the service station pallet 1910 (see, FIG. 19), while the blocks in the right column all refer to motion of the printhead carriage 1840 along the scanning axis 1838 (see, FIG. 18). For purposes of discussion, the operations of the procedure 2100 are described in reference to the features of FIGS. 9–20, the left-most digit of a reference number indicating the figure in which the feature was first introduced. Motion of both the service station pallet and the carriage are in response to control signals received from the imaging device controller 1830. Here, the servicing routine 2100 begins following completion of a print job, with the carriage being located in the print zone 1835.

At block 2102, the service station pallet is moved in direction 2116 to a forward position. At block 2104, the carriage 1840 enters the servicing region 1842. At this point, the carriage 1840 has positioned the printheads 1012 over corresponding spittoons 1010. The horizontal arrows 1104–1112 of FIG. 11 illustrate this motion to/from the print zone 1102. The spitting position is shown in FIG. 13 with a side view of a printhead in a spitting position. At block 2106, the pens then spit black ink and color ink respectively into the spittoons.

At block 2108, the service station pallet 2110 may optionally move rearward 1918 from the spittoon area 1010 to wipe the printheads clean of any ink residue on corresponding wiping units 1008—as also illustrated in FIGS. 14 and 15. Following this optional wiping operation, at block 2110 the service station pallet 2110 then moves to a full rearward 1918 position such that solvent nibs 1006 are pressing against the leading edge of respective staggered printheads 1012. At 2112, the carriage engages the solvent nibs at each printhead for solvent. Following the solvent application, the spitting 2106 and wiping operations 2108 may optionally be repeated.

At block 2114, the carriage then locates the printheads 1012 adjacent the caps 1002 for sealing. This movement is shown in FIG. 11 with the zigzag arrows from the spitting region 1010 to the capping region 1002. A side view of a capped printhead is shown in FIG. 12. At block 2116, the service station pallet 2110 moves partially forward to cap the printheads.

To ready the printheads 1012 for printing, block 2118 is performed, where the service station pallet 2110 moves in a fully forward direction 2116 to uncap the printheads. As a portion of this uncapping operation, optionally the printheads may be spit as described above, and this spitting may be followed by an optional wiping operation as described above. After uncapping the printheads 1012, at block 2120, the carriage 1840 may exit the servicing region 1842 and enter the print zone 1835 to perform a print job. At block 2114, the service station pallet 2110 is moved in the rearward direction 2118 to a rest position to conclude the printhead servicing routine.

During the printing process the carriage 1836 may again move the staggered printheads 1012 to the servicing region 1842 for optional spitting, wiping, and solvent as discussed above.

CONCLUSION

Although the subject matter has been described in language specific to structural features and/or methodological operations, it is to be understood that the subject matter defined in the appended claims is not necessarily limited to the specific features or operations described. For example, the zigzag arrow 1014 of FIG. 10 shows the relative motion of a printhead to/from a capping unit 1002 relative to the position of the spittoon reservoir 1010. Instead of a zigzag motion, the spittoon's width is enlarged to allow a straight motion to/from the capping station to/from the spittoon. Thus, the specific features and operations are disclosed as preferred forms of implementing the claimed features.

The invention claimed is:

1. An inkjet-imaging device comprising:

staggered printheads;

cleaning units coupled to a service station, each cleaning unit comprising components to service a particular one of the staggered printheads, each cleaning unit being offset from an adjacent cleaning unit to form a staggered cleaning unit configuration; and a processor coupled to a memory, the memory comprising computer-program instructions executable by the processor for collectively moving one or more of the staggered printheads along a single actuation axis from a respective spittoon in a particular service station to a print zone without colliding with one of the cleaning units.

2. An inkjet-imaging device as recited in claim 1, wherein the computer-program instructions further comprise instructions for collectively moving one or more of the staggered printheads along a single actuation axis to the respective spittoon in the particular service station from the print zone without colliding with one of the cleaning units.

3. An inkjet-imaging device as recited in claim 1, wherein the particular one is selected from a cyan ink printhead, a magenta ink printhead, a yellow ink printhead, or a black ink printhead.

4. An inkjet-imaging device as recited in claim 1, wherein the components comprise a spittoon, a wiper, a capping region, and a solvent dispenser.

5. An inkjet-imaging device as recited in claim 1, wherein the computer-program instructions further comprise instructions, responsive to moving the staggered printheads to the service station, for servicing the staggered printheads with the cleaning units.

6. An inkjet-imaging device as recited in claim 1, wherein each cleaning unit comprises a spittoon, a wiper, a capping unit, and a solvent dispenser, the wiper being positioned adjacent to the capping unit, the capping unit comprising a long and a short axis, a first end of the long axis being positioned adjacent the spittoon region, and a second end of the long axis unit being collinear and adjacent to the solvent dispenser.

7. A printhead cleaning unit for use in an inkjet printing device, the printhead cleaning unit comprising a plurality of components to service a particular one printhead of a plurality of staggered printheads, the components comprising a spittoon, a wiper, a capping unit, and a solvent dispenser, the wiper being positioned adjacent to the capping unit, the capping unit comprising a long and a short axis, a first end of the long axis being positioned adjacent the spittoon region, and a second end of the long axis unit being collinear and adjacent to the solvent dispenser.

8. A printhead cleaning unit as recited in claim 7, wherein the particular one printhead is a printhead comprising cyan, magenta, yellow, or black ink.

9. A method to service printheads in a staggered configuration, the method comprising:

moving a service station pallet to a forward position, the service station comprising printhead cleaning units in a staggered configuration, each cleaning unit comprising a spittoon;

repositioning the printheads into the service station such that each printhead is over a corresponding spittoon; and spitting ink, by each printhead, into a corresponding spittoon.

10. A method as recited in claim 9, wherein the staggered printheads comprise a cyan ink printhead, a magenta ink printhead, a yellow ink printhead, and/or a black ink printhead.

11. A method as recited in claim 9, wherein the cleaning units further comprise a wiper a solvent dispenser, and a capping unit, and wherein the wiper is positioned adjacent to the capping unit, the capping unit comprising a long and a short axis, a first end of the long axis being positioned adjacent the spittoon region, and a second end of the long axis unit being collinear and adjacent to the solvent dispenser.

12. A method as recited in claim 9, wherein each cleaning unit further comprises a wiper positioned near a second end of the cleaning unit, and wherein the method further comprises moving the service station pallet rearward to wipe each of the printheads clean of any ink residue on a corresponding wiper.

13. A method as recited in claim 9, wherein each cleaning unit further comprises a wiper and a solvent dispenser positioned near a second end of the cleaning unit, and wherein the method further comprises:

moving the service station pallet to a full rearward position such that corresponding solvent nibs are pressing against leading edges of respective staggered printheads, each solvent nib being associated with a respective solvent dispenser; and delivering solvent to the staggered printheads via the corresponding solvent nibs.

14. A method as recited in claim 9, wherein each cleaning unit further comprises, positioned near a second end of the cleaning unit: a wiper, a solvent dispenser and a capping region, and wherein the method further comprises:

moving the service station pallet to a printhead capping position; and sealing each of the staggered printheads with a respective cap at a respective capping region.

15. A computer-readable medium to service staggered printheads in an inkjet-imaging device, the computer-readable medium comprising computer-executable instructions for:

moving a service station pallet to a forward position, the service station comprising printhead cleaning units in a staggered configuration, each of the printhead cleaning units comprising a spittoon reservoir;

repositioning the staggered printheads into the service station such that each printhead is over a corresponding spittoon reservoir; and spitting ink, by each printhead, into a corresponding spittoon reservoir.

16. A computer-readable medium as recited in claim 15, wherein the staggered printheads comprise a cyan ink printhead, a magenta ink printhead, a yellow ink printhead, and/or a black ink printhead.

17. A computer-readable medium as recited in claim 15, wherein the printhead cleaning units further comprise a wiper a solvent dispenser, and a capping unit, and wherein the wiper is positioned adjacent to the capping unit, the capping unit comprise a long and a short axis, a first end of the long axis being positioned adjacent the spittoon region, and a second end of the long axis unit being collinear and adjacent to the solvent dispenser.

18. A computer-readable medium as recited in claim 15, wherein each of the printhead cleaning units further comprise a wiper, and wherein the computer-executable instructions further comprise instructions for moving the service station pallet rearward to wipe each of the printheads clean of any ink residue on a corresponding wiper.

19. A computer-readable medium as recited in claim 15, wherein each of the printhead cleaning units further comprise a wiper and a solvent dispenser, and wherein the computer-executable instructions further comprise instructions for:

moving the service station pallet to a full rearward position such that corresponding solvent nibs are pressing against leading edges of respective staggered printheads, each solvent nib being associated with a respective solvent dispenser; and delivering solvent to the staggered printheads via the corresponding solvent nibs.

20. A computer-readable medium as recited in claim 15, wherein the computer-executable instructions further comprise instructions for:

moving the service station pallet to a printhead capping position; and sealing each of the staggered printheads with a respecting cap in a respective capping region.

21. A method for servicing printheads in an inkjet-imaging device, the method comprising collectively moving one or more of staggered printheads along a single actuation axis from a respective spittoon in a particular service station to a print zone without colliding with any portion of a cleaning unit of cleaning units, each cleaning unit comprising components to service a particular one of the staggered printheads, each cleaning unit being offset from an adjacent cleaning unit to form a staggered cleaning unit configuration.

22. A method as recited in claim 21, where the particular one printhead is a cyan, magenta, yellow, or black ink printhead.

23. A method as recited in claim 21, wherein the components comprise a spittoon, a wiper, a capping region, and a solvent dispenser.

24. A method as recited in claim 23, wherein the wiper is positioned adjacent to a short axis of capping unit, the capping unit comprising a long and the short axis, a first end of the axis being positioned adjacent the spittoon region, and a second end of the long axis unit being collinear and adjacent to the solvent dispenser.

25. A method as recited in claim 21, wherein the method further comprises collectively moving one or more of staggered printheads along the single actuation axis to the respective spittoon in the particular service station from the print zone without colliding with any portion of a cleaning unit of cleaning units.

26. A computer-readable medium comprising computer-program instructions executable by a processor for servicing printheads in an inkjet-imaging device by:

collectively moving one or more of staggered printheads along a single actuation axis from a respective spittoon in a particular service station to a print zone without colliding with any portion of a cleaning unit of cleaning units, each cleaning unit comprising components to service a particular one of the staggered printheads, each cleaning unit being offset from an adjacent cleaning unit to form a staggered cleaning unit configuration; and responsive to moving the one or more staggered printheads to the service station, servicing the one or more staggered printheads with the cleaning units.

27. A computer-readable medium as recited in claim 26, wherein the computer-executable instructions further comprise instructions for collectively moving one or more of staggered printheads along a single actuation axis to a respective spittoon in a particular service station from the print zone without colliding with any portion of a cleaning unit of cleaning units.

28. A computer-readable medium as recited in claim 26, wherein the components comprise a spittoon, a wiper, a capping unit, and a solvent dispenser, the wiper being positioned adjacent to the capping unit, the capping unit comprising a long and a short axis, a first end of the long axis being positioned adjacent the spittoon region, and a second end of the long axis unit being collinear and adjacent to the solvent dispenser.

29. An inkjet imaging device comprising:

means for collectively moving one or more of staggered printheads along a single actuation axis to a respective spittoon in a particular service station from a print zone without colliding with any portion of a cleaning unit of cleaning units, each cleaning unit comprising components to service a particular one of the staggered printheads, each cleaning unit being offset from an adjacent cleaning unit to form a staggered cleaning unit configuration; and responsive to moving the one or more staggered printheads to the service station, means for servicing the one or more staggered printheads with the cleaning units.

30. An inkjet imaging device as recited in claim 29, further comprising means for collectively moving one or more of staggered printheads along the single actuation axis from a respective spittoon in a particular service station to the print zone without colliding with any portion of a cleaning unit of cleaning units.

* * * * *

UNITED STATES PATENT AND TRADEMARK OFFICE

CERTIFICATE OF CORRECTION

PATENT NO. : 7,097,275 B2
APPLICATION NO. : 10/682502
DATED : August 29, 2006
INVENTOR(S) : Antoni S. Murcia et al.

It is certified that error appears in the above-identified patent and that said Letters Patent is hereby corrected as shown below:

On the Title Page, Item (73) under "Assignee", delete "Hoston," and insert -- Houston, --, therefor.

On the Title Page, Item (57) under "Abstract", line 1, delete "System" and insert -- Systems --, therefor.

In column 4, line 12, delete "deaning" and insert -- cleaning --, therefor.

In column 13, line 60, in Claim 17, delete "comprise" and insert -- comprising --, therefor.

In column 14, line 32, in Claim 22, delete "where" and insert -- wherein --, therefor.

In column 14, line 33, in Claim 22, after "or" insert -- a --.

In column 14, line 39, in Claim 24, after "axis of" insert -- the --.

In column 14, line 41, in Claim 24, after "of the" insert -- long --.

Signed and Sealed this

Tenth Day of February, 2009

John Doll

JOHN DOLL
*Acting Director of the United States Patent and Trademark Office*